US010767945B2

(12) United States Patent
Gruening

(10) Patent No.: US 10,767,945 B2
(45) Date of Patent: Sep. 8, 2020

(54) WEAPON MAGAZINE CUSHION

(71) Applicant: TechnoGel GmbH, Duderstadt (DE)

(72) Inventor: Niclas Gruening, Duderstadt (DE)

(73) Assignee: TechnoGel GmbH, Duderstadt (DE)

( * ) Notice: Subject to any disclaimer, the term of this patent is extended or adjusted under 35 U.S.C. 154(b) by 0 days.

(21) Appl. No.: 16/120,542

(22) Filed: Sep. 4, 2018

(65) Prior Publication Data

US 2019/0072347 A1 Mar. 7, 2019

(30) Foreign Application Priority Data

Sep. 5, 2017 (DE) ..... 10 2017 120 365

(51) Int. Cl.
*F41A 9/65* (2006.01)
*F41A 35/00* (2006.01)
*F41C 23/16* (2006.01)

(52) U.S. Cl.
CPC ..... *F41A 9/65* (2013.01); *F41A 35/00* (2013.01); *F41C 23/16* (2013.01)

(58) Field of Classification Search
CPC .. F41A 9/65; F41A 35/00; F41C 23/16; F41C 23/10
USPC ..... 42/49.01–49.1, 74
See application file for complete search history.

(56) References Cited

U.S. PATENT DOCUMENTS 2,650,446 A * 9/1953 Bivens ..... F41C 23/20 42/74
2,745,203 A * 5/1956 Ruple ..... F42B 39/24 42/50
4,456,642 A 6/1984 Burgdorfer et al.
4,661,099 A 4/1987 Von Bittera et al.
4,998,367 A * 3/1991 Leibowitz ..... F41C 23/06 42/71.02
5,052,138 A * 10/1991 Crain ..... F41A 9/62 42/1.02
5,293,708 A * 3/1994 Strayer ..... F41A 9/70 42/7
5,362,834 A 11/1994 Schaepel et al.
5,642,582 A * 7/1997 Grams ..... F41A 9/65 42/50
5,666,752 A * 9/1997 Grams ..... F41A 9/71 42/49.02

(Continued)

FOREIGN PATENT DOCUMENTS

DE 33 41 555 A1 5/1985
DE 201 19 940 U1 2/2002

(Continued)

*Primary Examiner* — Michael D David

(74) *Attorney, Agent, or Firm* — W & C IP

(57) ABSTRACT

The weapon magazine cushion is a protective accessory for releasably fastening to a weapon magazine having a magazine base that is directed outward at the lower grip end of the weapon in the installed position and has a substantially planar magazine-base underside to which the weapon magazine cushion is fastened in a self-adhesive manner. It has a blocklike body with a flat abutment side directed toward the magazine-base underside with a rounded end face. The body is formed from an adhesive polyurethane gel material that is elastically deformable under pressure and is enclosed by a non-adhesive and protective skin, apart from on the abutment side.

12 Claims, 1 Drawing Sheet

(56) References Cited

U.S. PATENT DOCUMENTS

| | | | | |
|---|---|---|---|---|
| 6,073,381 | A * | 6/2000 | Farrar | F41C 23/10 42/71.02 |
| D493,861 | S * | 8/2004 | Rauch | D22/108 |
| 9,459,072 | B2 * | 10/2016 | Kafer | F41C 23/16 |
| 10,151,546 | B2 * | 12/2018 | Baker | F41A 9/65 |
| 2002/0172034 | A1 * | 11/2002 | Lawless | F41G 1/35 362/110 |
| 2004/0144011 | A1 * | 7/2004 | Vignaroli | F41C 23/08 42/74 |
| 2004/0255504 | A1 * | 12/2004 | Fitzpatrick | F41A 9/65 42/49.01 |
| 2007/0025101 | A1 * | 2/2007 | Lawless | F41A 9/61 362/110 |
| 2008/0190003 | A1 * | 8/2008 | Bolen | F41A 9/61 42/50 |
| 2013/0042514 | A1 * | 2/2013 | Douglas | F41A 9/65 42/50 |
| 2013/0333261 | A1 * | 12/2013 | Clifton, Jr. | F41A 9/65 42/50 |
| 2014/0047751 | A1 * | 2/2014 | Lee | F41A 9/65 42/49.01 |
| 2015/0259100 | A1 * | 9/2015 | Boisseau | B65D 25/56 42/50 |
| 2015/0316337 | A1 | 11/2015 | Alkhalaileh et al. | |
| 2017/0191771 | A1 * | 7/2017 | Zimmer | F41A 9/62 |
| 2017/0205168 | A1 * | 7/2017 | Chen | F41A 9/65 |

FOREIGN PATENT DOCUMENTS

| | | | |
|---|---|---|---|
| DE | 10 2005 028 603 | A1 | 12/2006 |
| EP | 057 838 | A1 | 8/1982 |
| EP | 0 511 570 | A1 | 11/1992 |

* cited by examiner

WEAPON MAGAZINE CUSHION

FIELD OF THE INVENTION

The invention relates to a weapon magazine cushion (magazine bumper), in particular for a boxlike or in the broadest sense cuboidal bullet magazine that is arranged in a grip of a firearm, such as a handgun, or is enclosed by grip plates, in particular what is known as a stick magazine.

BACKGROUND

DE 201 19 940 U1 (Jonait) discloses a magazine cushion which has been designed and optimized for angular carbine or machine gun magazines. Such a magazine projects freely from around the middle of the weapon. The drawbacks that are associated therewith and are to be overcome consist in that the metallic magazine presses against the user with the weight of the weapon and can cause injuries and damage to clothing, particularly when it has previously been bent or damaged by mechanical stress. A magazine cushion made of a rubberlike soft material, which can be pulled over the base plate and the lower end of the magazine, remedies this. Rattling noises are damped, pressure and rubbing on the body of the user are reduced. Such a cushion is not usable for gun stick magazines which are pushed into a grip.

It is known practice to attach cushions to magazine bases or to switch a magazine base for an extended and/or cushioned magazine base.

DE 10 2005 028 603 B4 (Walther) describes an exchangeable magazine base, which is releasably fixable to a boxlike or cuboidal magazine housing. The magazine form shown is also referred to as a stick magazine. By way of the magazine base—referred to therein as "magazine-base device"—a magazine housing is closed in the region of the end of the grip of a firearm, such as in particular a handgun. The magazine base in DE 10 2005 028 603 B4 serves to enlarge the spring-free space within the magazine housing and thus to enlarge the loading space for bullets. It also allows the magazine base to be fixed securely to the magazine housing and is intended to be quickly and reliably exchangeable.

In general, a magazine base comprises a plurality of parts, including fastening means for fastening to the magazine housing, which can comprise for example latching means and/or screws and optionally springs, a magazine base plate, which represents a spring platform or contains a bearing for the magazine spring, and a magazine base cover arranged therebeneath (on the outside), which can also be configured as a hollow form and consists of the magazine material, for example steel, aluminum or plastic, or for example of a particular softer material for shock absorption, in particular a plastic (also "magazine bumper").

During the releasable fastening of the magazine base, particular attention has to be paid to the secure mounting and fixing of the magazine spring, which is inserted under high preloading and exerts a large pressure on the bullets.

Therefore, exchanging the magazine base requires skill and practice and is not without risk on account of the high magazine spring tension.

Magazines and magazine bases, in particular those which differ from those originally delivered with the weapon, i.e. from the original equipment, are sold commercially as accessories appropriate for the weapon type and manufacturer.

A magazine base that differs from the original base can be provided for example to extend and enlarge the magazine, to extend the finger contact surface at the lower end of the grip, or to integrate a base cushion, in particular as a drop bumper and impact protection for the optionally extended magazine. The changing of the entire magazine base is in this case always associated with the above-described conversion problems.

SUMMARY

The object of the invention is now to provide particular functions of an interchangeable magazine base, inter alia for stick magazines, specifically in particular for cushioning impacts, without the magazine base itself having to be changed.

This object is achieved by a weapon magazine cushion having the features of claim 1. The weapon magazine cushion represents a protective accessory for a weapon magazine, which can be fastened in a self-adhering manner and released again multiple times.

The weapon magazine cushion according to the invention—provided for releasably fastening to a weapon magazine having a magazine base that is directed outward at the lower grip end of the weapon in the installed position and has a substantially planar magazine-base underside—is distinguished by the fact that it has a blocklike body with a flat abutment side directed toward the magazine-base underside, and with a rounded end face, the body being formed from an adhesive polyurethane gel material that is elastically deformable under pressure and is enclosed by a skin, apart from on the abutment side, on which the magazine cushion comes into self-adhering contact with the magazine base.

The body of the weapon magazine cushion made of the adhesive, self-adhering material is formed such that the adhesive, "tacky" polyurethane gel is not covered on the flat or planar abutment side of the body and the rest of the surface is provided with a skin.

As polyurethane gel, it is possible to use a gel as is described in DE 33 41 555 A1 as a self-adhering polyurethane gel. Further suitable gels can be found by a person skilled in the art in the documents EP 0057838 A1 or EP 0511570 A1, the disclosure of which with regard to suitable gels is expressly referred to here.

The preferred tacky gels are exclusively polyurethane gels, i.e. those in which the stationary and the fluid gel phases are formed from constituents of the gel mass. No hydrogels are used. During the production of the gels, isocyanates or NCO prepolymers with long-chain polyols, preferably with molecular weights of between about 1000 and 12 000 and OH numbers of between 20 and 112 are reacted in such a ratio that the polyol used, which is incorporated into the crosslinked polyurethane by primary or secondary valence forces, at the same time forms an extender phase or fluid gel phase. The isocyanate index is preferably between 16 and 80.

Measures for skin application are known to a person skilled in the art and therefore do not need to be described separately here.

The weapon magazine cushion according to the invention is suitable for many, if not most gun magazines, having a substantially planar magazine base. Therefore, the magazine cushion can be configured as a universal cushion for different magazine types from different manufacturers. This is possible because the base surfaces of the lower magazine ends or bases do not differ greatly from one another for anatomical reasons (similar hand size of an average user/shooter). Specific fastening means, typical for the magazine type, are not necessary.

For the weapon magazine on which the magazine cushion is intended to be used, only a few requirements apply. First of all, the base must be substantially planar. On account of the elastic structure of the cushion, it is quite possible, however, for, for example, slight bulges or recesses, grooves, ridges and the like in the surface to be able to be compensated by the cushion and are irrelevant here.

The weapon magazine on which the magazine cushion can be used is preferably a substantially cuboidal magazine, more preferably a box magazine, stick magazine, trapezoidal magazine or curved magazine.

The weapon magazine cushion forms very effective impact protection when the magazine drops to the ground. Any impacts on the magazine base are readily absorbed.

In contrast to soft magazine "bumpers", which absorb the impact energy with plastic deformation, such that such a bumper can then be unusable, as occurs in particular in the case of plastics interchangeable bases, the structurally stable polyurethane gel that is elastically deformable under pressure behaves elastically and returns to its original shape after the impact.

Therefore, the weapon magazine cushion has good durability. It can additionally be detached from a magazine and used further on a different magazine.

The uniform impact absorption for different impact situations can additionally be supported by preferred designs of the magazine cushion.

Preferably, the body of the weapon magazine cushion is at least regionally beveled or rounded at an encircling edge on its side remote from the abutment side, i.e. the base side of the cushion that is directed downward from the grip end in the use position.

Preferably, at least a side, formed in continuation of the magazine housing sides, of the substantially blocklike magazine cushion body is beveled or rounded, in particular beveled or rounded at its lower end facing away from the abutment side.

In a preferred embodiment, the magazine cushion body is beveled at least on the opposite side from the rounded end side.

Depending on the embodiment, the magazine cushion is 35 to 45 mm long, 25 to 35 mm wide and 2 to 20 mm high or thick. The width, length and shape of the contact surface result from the magazine shape and are thus fixed. The above values are intended to provide merely indications and serve for greater clarity.

In preferred embodiments, the weapon magazine cushion, or the body thereof, has a thickness of at least 2 mm. This thickness is sufficient to give the cushion good impact absorbing properties.

If an extension of the magazine by the cushion is additionally planned, for example in order to improve the grip of the shooter or to make gripping more comfortable, a thickness of at least 2, preferably 4 mm, with respect to the outer edge with the finger contact surface is preferably provided at least on the end side of the magazine cushion.

At least one of the beveled faces of the body is more preferably wider than the maximum thickness of the body.

In preferred embodiments, the polyurethane gel material of the magazine cushion body is set to a maximum Shore-A value of 60, and preferably the gel material of the magazine cushion body has a Shore-000 hardness of 15 to a Shore-A hardness of 60. The gel material absorbs impacts and returns into its original shape after the impact.

The weapon magazine cushion can preferably be produced in a molding or injection-molding process. The skin application to such bodies is known to a person skilled in the art and does not need to be explained in more detail here. For example, a suitable, nonadhesive film can be laid in the mold in advance (by thermoforming of the film into the mold).

In general, the skin can be formed on the outwardly directed sides of the body, apart from on the abutment side, by a sprayed skin, painting, coating or an applied film.

The gel material and/or the skin can be dyed. As a result, particularly good adaptation to the appearance and the color of the magazine or of the grip or the grip plates is possible. In addition, the skin can be structured.

Particular advantages of the invention are:

- the adhesion to virtually any weapon magazine material, in particular to metal, such as steel or aluminum, plastic and wood;
- the usability on any desired magazines, as long as they have a planar base;
- the exchangeability without the use of separate fastening means;
- the multiple usability on account of the releasable fastening by self-adhesion, wherein clean removal is possible;
- the easy cleaning of the cushion by washing with a simple soap solution;
- the soft extension, which makes it easier to use the assembled magazine since it allows a better more secure grip upon insertion until latching;
- the universal usability for many magazine types and brands by simple shaping.

The invention is suitable for all metal and plastics magazines, for example those from the manufacturers Glock, Colt, Beretta, Walther, Webley, MAS, inter alia.

DESCRIPTION OF THE DRAWINGS

In the following text, the invention is explained in more detail by reference to an exemplary embodiment shown in the drawing, in which.

DETAILED DESCRIPTION

The illustration is schematic and not to scale. FIG. 1 shows a weapon magazine cushion 10 according to the invention in different views, in section from the front or rear, in plan view and in section from the side. In this case, identical elements are provided with the same reference signs.

Figure 1A:
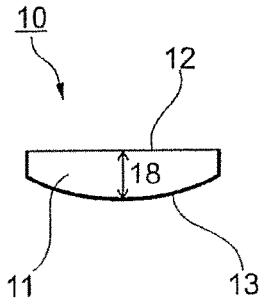
FIG. 1*a* shows a weapon magazine cushion schematically in cross section as seen from one of the end sides.

FIG. 1*a* shows the weapon magazine cushion 10, which has a dimensionally stable, injection-molded body 11 made of a polyurethane gel, as seen in a cross-sectional view from one of the end sides, i.e. in transverse section. The cross-sectional shape of the body 11 can be seen, which—apart from on the abutment side 12, with which the body 11 bears against a magazine that is not shown in this illustration and adheres thereto—is enclosed by a skin 13. The body 11 has a thickness 18. This thickness is a maximum thickness; toward its edges, the body is beveled or rounded, such that the thickness is smaller there. As the cross section shows, the weapon magazine cushion 10 illustrated here is rounded in the transverse direction.

Figure 1B:
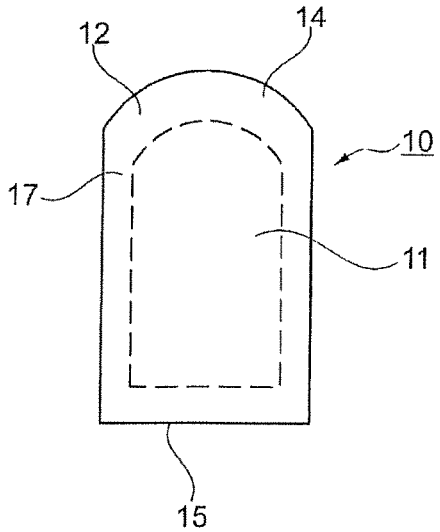
FIG. 1*b* shows the weapon magazine cushion schematically in plan view of the flat side/abutment side.

FIG. 1*b* shows a plan view of the flat side, or the abutment side 12. The body 11 or the weapon magazine cushion 10 as a whole is not provided with the skin 13 on this side, and so the gel material is exposed and can be brought into adhesive contact with the magazine to which it is intended to be applied. The weapon magazine cushion 10 is rounded on one end side 14. On the abutment side 12, it is tacky and as a result self-adhering to different surfaces. The surface of the abutment side 12 is shaped such that it matches numerous common magazine base plate forms.

Figure 1C:
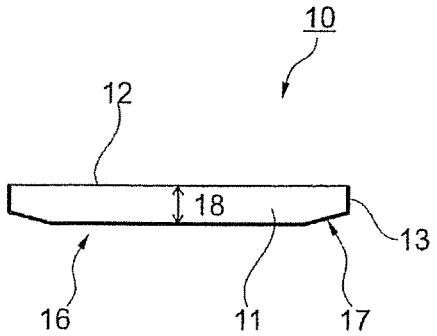
FIG. 1*c* shows the weapon magazine cushion schematically in cross section from the side.

FIG. 1*c* shows a cross-sectional view of the same weapon magazine cushion 10 from the side, i.e. in longitudinal section. The free abutment side 12, not provided with a skin, and the opposite side 16 provided with the skin 13 can be seen. At the encircling edge 17, the weapon magazine cushion 10 is inclined in the longitudinal direction and—as was previously apparent in FIG. 1*a*—rounded in the transverse direction.

Figure 2:
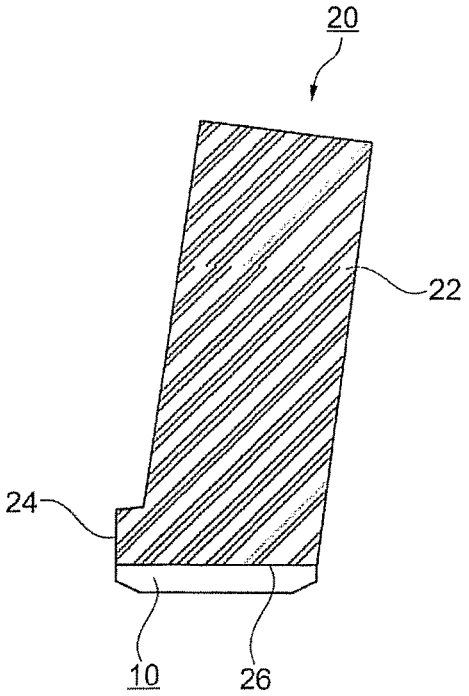
FIG. 2 shows a schematic view of the weapon magazine cushion attached to a magazine, in side view.

FIG. 2 shows the weapon magazine cushion 10, as described above, in abutment against a conventional weapon magazine 20. The magazine has a magazine housing 22 and a magazine base 24 having a magazine base underside 26. The weapon magazine cushion 10 adheres to this magazine base underside 26, which is formed in an entirely planar manner here.

The invention claimed is:

1. A weapon magazine cushion for releasably fastening to a weapon magazine having a magazine base that is directed outward at a lower grip end of a weapon in an installed position and has a substantially planar magazine-base underside, comprising:

a blocklike body with a flat abutment side configured for direction toward a magazine-base underside, wherein the body has a rounded end, and wherein the body is formed from an adhesive polyurethane gel material that is elastically deformable under pressure and is enclosed by a skin apart from on the abutment side, and wherein the adhesive polyurethane gel is self adhering, and on the abutment side is fastenable and releasable from the magazine-base underside.

2. The weapon magazine cushion as claimed in claim 1 configured for fastening to a substantially cuboidal magazine.

3. The weapon magazine cushion as claimed in claim 1 configured for fastening to a box magazine, stick magazine, trapezoidal magazine or curved magazine.

4. The weapon magazine cushion as claimed in claim 1 wherein the body is fully or regionally beveled or rounded at an encircling edge on a side remote from the abutment side.

5. The weapon magazine cushion as claimed in claim 1 wherein the body is beveled on a side opposite from the rounded end.

6. The weapon magazine cushion as claimed in claim 1 wherein the body has a thickness of at least 2 mm.

7. The weapon magazine cushion as claimed in claim 1 wherein the body has a beveled face, and wherein the beveled face is wider than a thickness of the body.

8. The weapon magazine cushion as claimed in claim 1 wherein the gel material of the body has a Shore-000 hardness of 15 to a Shore-A harness of 60.

9. The weapon magazine cushion as claimed in claim 1 wherein the skin is formed on outwardly directed sides of the body apart from en the abutment side by a sprayed skin, painting, coating or an applied film.

10. The weapon magazine cushion as claimed in claim 1 wherein the gel material and/or the skin is dyed.

11. A weapon magazine comprising a weapon magazine cushion as recited in claim 1 attached to a base of the weapon magazine.

12. The weapon magazine of claim 11 wherein the weapon magazine is a box magazine, stick magazine, trapezoidal magazine or curved magazine.

* * * * *